US009988876B2

(12) United States Patent
Brasseaux et al.

(10) Patent No.: US 9,988,876 B2
(45) Date of Patent: Jun. 5, 2018

(54) VALVE OPERABLE BETWEEN OPEN AND CLOSED CONFIGURATIONS IN RESPONSE TO SAME DIRECTION DISPLACEMENT

(71) Applicant: WEATHERFORD TECHNOLOGY HOLDINGS, LLC, Houston, TX (US)

(72) Inventors: Jason J. Brasseaux, Cypress, TX (US); Brian J. Ritchey, Hockley, TX (US); Joshua M. Hornsby, Tomball, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 187 days.

(21) Appl. No.: 15/012,453

(22) Filed: Feb. 1, 2016

(65) Prior Publication Data

US 2017/0218724 A1 Aug. 3, 2017

(51) Int. Cl.
*E21B 34/12* (2006.01)
*E21B 43/04* (2006.01)
(Continued)

(52) U.S. Cl.
CPC ..... *E21B 34/12* (2013.01); *E21B 43/045* (2013.01); *E21B 43/08* (2013.01); *E21B 43/16* (2013.01); *E21B 2034/005* (2013.01)

(58) Field of Classification Search
CPC .... E21B 34/12; E21B 34/14; E21B 2034/005; E21B 34/00
(Continued)

(56) References Cited

U.S. PATENT DOCUMENTS 3,221,820 A * 12/1965 Myers ..... E21B 34/12 166/237
4,273,190 A 6/1981 Baker et al.
(Continued)

FOREIGN PATENT DOCUMENTS

GB 2119426 A 11/1983
WO 2016/108886 7/2016

OTHER PUBLICATIONS

Combined Search and Examination Report dated Jun. 1, 2017 for UK Patent Application No. GB1701641.1, 5 pages.
(Continued)

*Primary Examiner* — David J Bagnell
*Assistant Examiner* — Jonathan Malikasim
(74) *Attorney, Agent, or Firm* — Smith IP Services, P.C.

(57) ABSTRACT

A valve assembly can include a generally tubular housing, a mandrel reciprocably disposed in the housing and operative to displace a valve closure in response to relative displacement between the mandrel and the housing, an engagement device reciprocably disposed externally on the housing and secured relative to the mandrel, so that the mandrel displaces with the engagement device, and a biasing device that biases the mandrel and engagement device in a selected longitudinal direction. A system can include a tubular string and a valve assembly reciprocably disposed in the tubular string, the valve assembly including a valve that selectively restricts flow through a longitudinal passage. The valve closes in response to displacement of the valve assembly in a selected longitudinal direction relative to the tubular string, and the valve opens in response to displacement of the valve assembly in the same longitudinal direction relative to the tubular string.

16 Claims, 10 Drawing Sheets

(51) Int. Cl.
*E21B 43/08* (2006.01)
*E21B 43/16* (2006.01)
*E21B 34/00* (2006.01)

(58) Field of Classification Search
USPC ..... 166/332.8
See application file for complete search history.

(56) References Cited

U.S. PATENT DOCUMENTS 4,411,316 A 10/1983 Carmody
4,423,773 A 1/1984 Stout
4,703,805 A 11/1987 Morris
4,729,432 A 3/1988 Helms
4,796,705 A 1/1989 Carmody et al.
5,413,180 A 5/1995 Ross et al.
7,387,164 B2 6/2008 Pringle et al.
7,980,316 B2 * 7/2011 Swenson ..... E21B 34/14 166/323
8,881,824 B2 * 11/2014 Stautzenberger ..... E21B 23/006 166/331
2005/0189117 A1 9/2005 Pringle et al.
2005/0230119 A1 10/2005 McGarian et al.
2009/0301732 A1 12/2009 Turner et al.
2013/0068476 A1 * 3/2013 Edwards ..... E21B 34/102 166/373

OTHER PUBLICATIONS

Specification and Drawings for U.S. Appl. No. 15/012,570, filed Feb. 1, 2016, 42 pages.
Halliburton; "Reverse Position Indicators", company brochure, Downhole Sand Components (3-43-3-44), received Jan. 12, 2016, 1 page.
Schlumberger; "MudSOLV Ballseat Module", company brochure, SC_03_041_0, dated Jan. 2004, 1 page.
Baker Hughes; "Sand Control Systems", Completions and Production company article, dated 2010, 3 pages.
Australian Examination Report dated Mar. 27, 2018 for AU Patent Application No. 2017200614, 6 pages.
U.S. Office Action dated Mar. 22, 2018 for U.S. Appl. No. 15/012,570, 23 pages.

* cited by examiner

VALVE OPERABLE BETWEEN OPEN AND CLOSED CONFIGURATIONS IN RESPONSE TO SAME DIRECTION DISPLACEMENT

BACKGROUND

This disclosure relates generally to equipment and operations utilized in conjunction with subterranean wells and, in an example described below, more particularly provides a downhole valve, and associated systems and methods.

Valves operable downhole can be used in gravel packing operations in wells. Although variations are possible, a gravel pack is generally an accumulation of "gravel" (typically sand, proppant or another granular or particulate material, whether naturally occurring or synthetic) about a tubular filter or screen in a wellbore. The gravel is sized, so that it will not pass through the screen, and so that sand, debris and fines from an earth formation penetrated by the wellbore will not easily pass through the gravel pack with fluid flowing from the formation. Although relatively uncommon, a gravel pack may also be used in an injection well, for example, to support an unconsolidated formation.

Placing the gravel about the screen in the wellbore is a complicated process, requiring relatively sophisticated equipment and techniques to maintain well integrity while ensuring the gravel is properly placed in a manner that provides for subsequent efficient and trouble-free operation. It will, therefore, be readily appreciated that improvements are continually needed in the arts of designing and utilizing gravel pack equipment and methods. Such improved equipment and methods may be useful with any type of gravel pack in cased or open wellbores, and in vertical, horizontal or deviated well sections.

The improved equipment and methods may also be used in other types of well operations. For example, drilling, fracturing, conformance, steam flooding, disposal and other operations could utilize concepts described more fully below.

DETAILED DESCRIPTION

Figure 1:
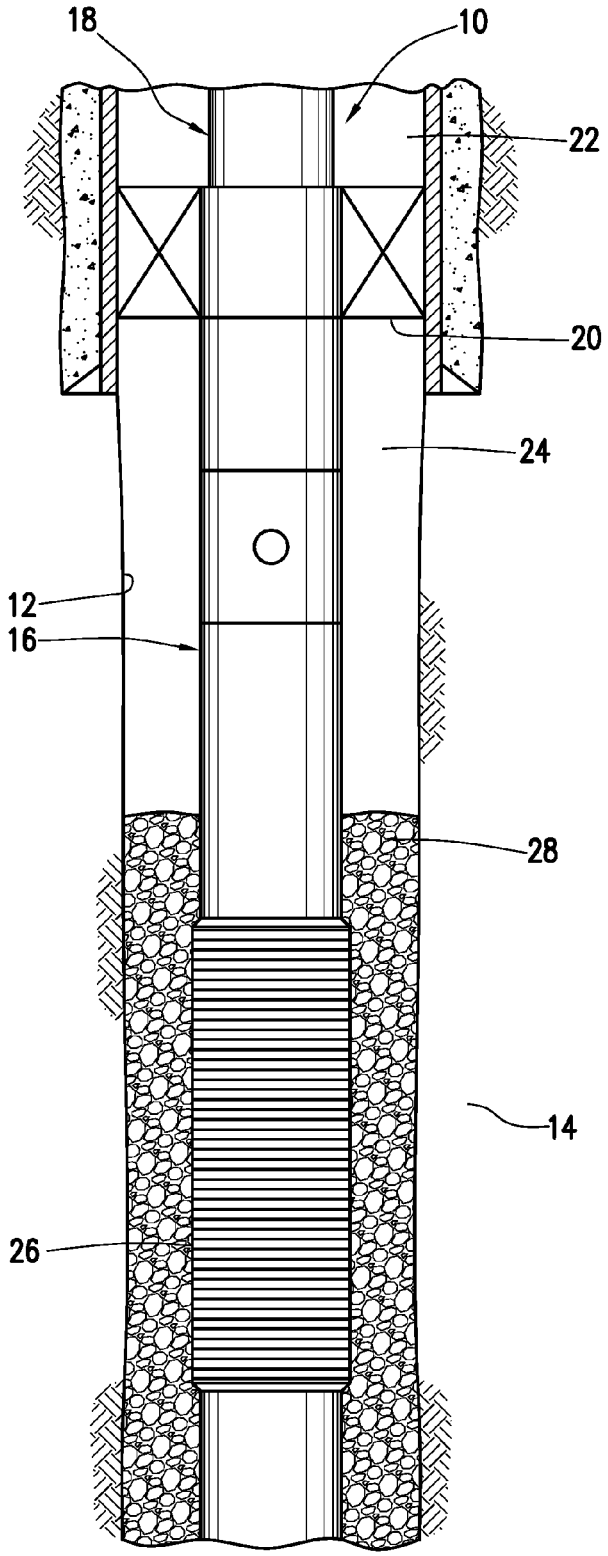
FIG. 1 is a representative partially cross-sectional view of an example of a gravel pack system and associated method which can embody principles of this disclosure.

Representatively illustrated in FIG. 1 is a gravel pack system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 has been drilled, so that it penetrates an earth formation 14. A well completion assembly 16 is installed in the wellbore 12, for example, using a generally tubular service string 18 to convey the completion assembly and set a packer 20 of the completion assembly.

Setting the packer 20 in the wellbore 12 provides for isolation of an upper well annulus 22 from a lower well annulus 24 (although, as described above, at the time the packer is set, the upper annulus and lower annulus may be in communication with each other). The upper annulus 22 is formed radially between the service string 18 and the wellbore 12, and the lower annulus 24 is formed radially between the completion assembly 16 and the wellbore.

The terms "upper" and "lower" are used herein for convenience in describing the relative orientations of the annulus 22 and annulus 24 as they are depicted in FIG. 1. In other examples, the wellbore 12 could be horizontal (in which case neither of the annuli would be above or below the other) or otherwise deviated. Thus, the scope of this disclosure is not limited to any relative orientations of examples as described herein.

As depicted in FIG. 1, the packer 20 is set in a cased portion of the wellbore 12, and a generally tubular well screen 26 of the completion assembly 16 is positioned in an uncased or open hole portion of the wellbore. However, in other examples, the packer 20 could be set in an open hole portion of the wellbore 12, and/or the screen 26 could be positioned in a cased portion of the wellbore. Thus, it will be appreciated that the scope of this disclosure is not limited to any particular details of the system 10 as depicted in FIG. 1, or as described herein.

In the FIG. 1 method, the service string 18 not only facilitates setting of the packer 20, but also provides a variety of flow passages for directing fluids to flow into and out of the completion assembly 16, the upper annulus 22 and the lower annulus 24. One reason for this flow directing function of the service string 18 is to deposit gravel 28 in the lower annulus 24 about the well screen 26.

Examples of some steps of the method are representatively depicted in FIGS. 2-7 and are described more fully below. However, it should be clearly understood that it is not necessary for all of the steps depicted in FIGS. 2-7 to be performed, and additional or other steps may be performed, in keeping with the principles of this disclosure.

Figure 2:
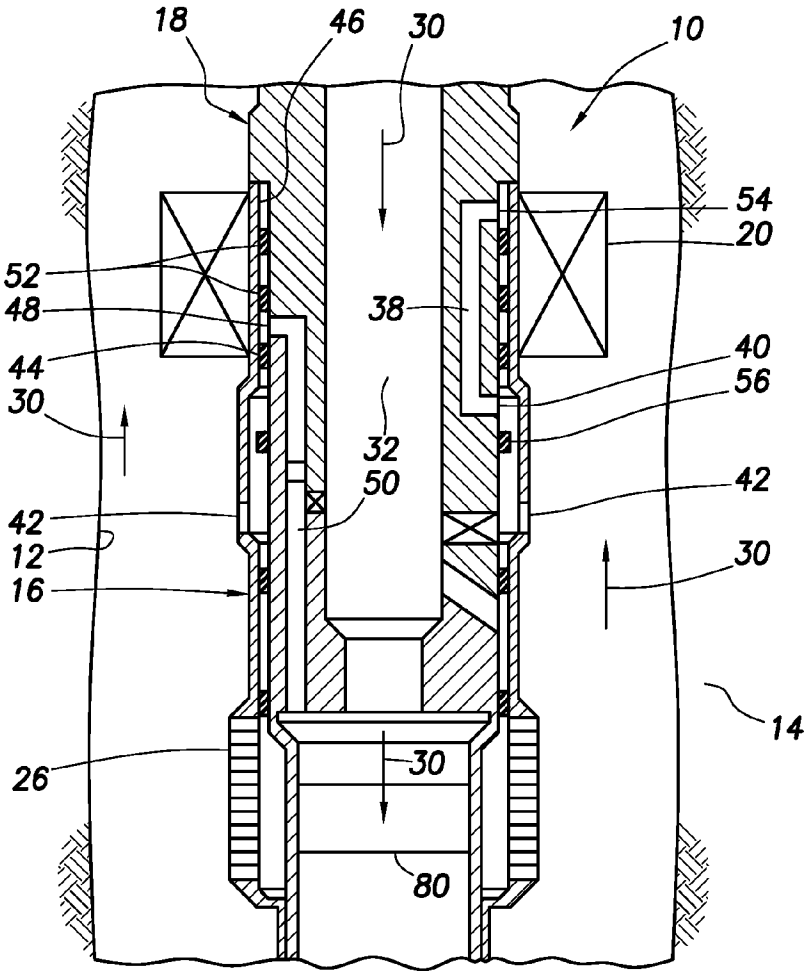

Referring now to FIG. 2, the system 10 is depicted as the service string 18 is being used to convey and position the completion assembly 16 in the wellbore 12. For clarity of illustration, the cased portion of the wellbore 12 is not depicted in FIGS. 2-7.

Note that, as shown in FIG. 2, the packer 20 is not yet set, and so the completion assembly 16 can be displaced through the wellbore 12 to any desired location. As the completion assembly 16 is displaced into the wellbore 12 and positioned therein, a fluid 30 can be circulated through a flow passage 32 that extends longitudinally through the service string 18. The fluid 30 can flow through an open valve assembly 80 of the service string 18.

Figure 3:
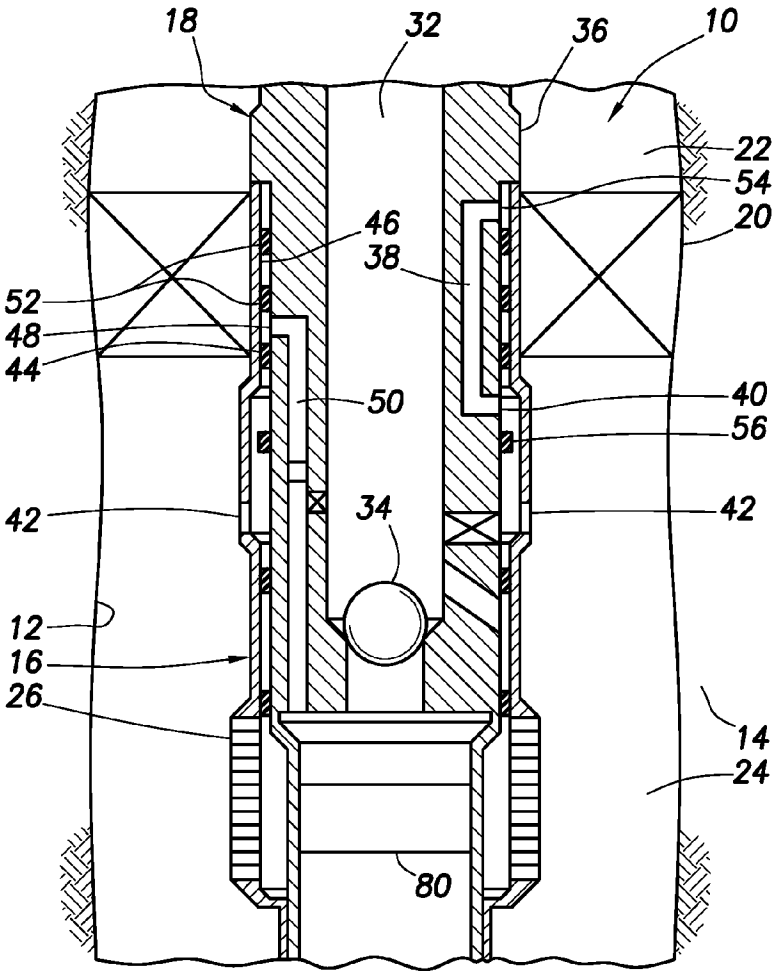
FIGS. 2-7 are representative cross-sectional views of a succession of steps in the method of gravel packing.

As depicted in FIG. 3, the completion assembly 16 has been appropriately positioned in the wellbore 12, and the packer 20 has been set to thereby provide for isolation between the upper annulus 22 and the lower annulus 24. In this example, to accomplish setting of the packer 20, a ball, dart or other plug 34 is deposited in the flow passage 32 and, after the plug 34 seals off the flow passage, pressure in the flow passage above the plug is increased.

This increased pressure operates a packer setting tool 36 of the service string 18. The setting tool 36 can be of the type well known to those skilled in the art, and so further details of the setting tool and its operation are not illustrated in the drawings or described herein.

Although the packer 20 in this example is set by application of increased pressure to the setting tool 36 of the service string 18, in other examples the packer may be set using other techniques. For example, the packer 20 could be set by manipulation of the service string 18 (e.g., rotating in a selected direction and then setting down or pulling up, etc.), with or without application of increased pressure. Thus, the scope of this disclosure is not limited to any particular technique for setting the packer 20.

Note that, although the set packer 20 separates the upper annulus 22 from the lower annulus 24, in the step of the method as depicted in FIG. 3, the upper annulus and lower annulus are not yet fully isolated from each other. Instead, another flow passage 38 in the service string 18 provides for fluid communication between the upper annulus 22 and the lower annulus 24.

In FIG. 3, it may be seen that a lower port 40 permits communication between the flow passage 38 and an interior of the completion assembly 16. Openings 42 formed through the completion assembly 16 permit communication between the interior of the completion assembly and the lower annulus 24. The valve assembly 80 remains in its open configuration.

An annular seal 44 is sealingly received in a seal bore 46. The seal bore 46 is located within the packer 20 in this example, but in other examples, the seal bore could be otherwise located (e.g., above or below the packer).

In the step as depicted in FIG. 3, the seal 44 isolates the port 40 from another port 48 that provides communication between another flow passage 50 and an exterior of the service string 18. At this stage of the method, no flow is permitted through the port 48, because one or more additional annular seals 52 on an opposite longitudinal side of the port 48 are also sealingly received in the seal bore 46.

An upper end of the flow passage 38 is in communication with the upper annulus 22 via an upper port 54. Although not clearly visible in FIG. 3, relatively small annular spaces between the setting tool 36 and the packer 20 provide for communication between the port 54 and the upper annulus 22.

Thus, it will be appreciated that the flow passage 38 and ports 40, 54 effectively bypass the seal bore 46 (which is engaged by the annular seals 44, 52 carried on the service string 18) and allow for hydrostatic pressure in the upper annulus 22 to be communicated to the lower annulus 24. This enhances wellbore 12 stability, in part by preventing pressure in the lower annulus 24 from decreasing (e.g., toward pressure in the formation 14) when the packer 20 is set.

Figure 4:
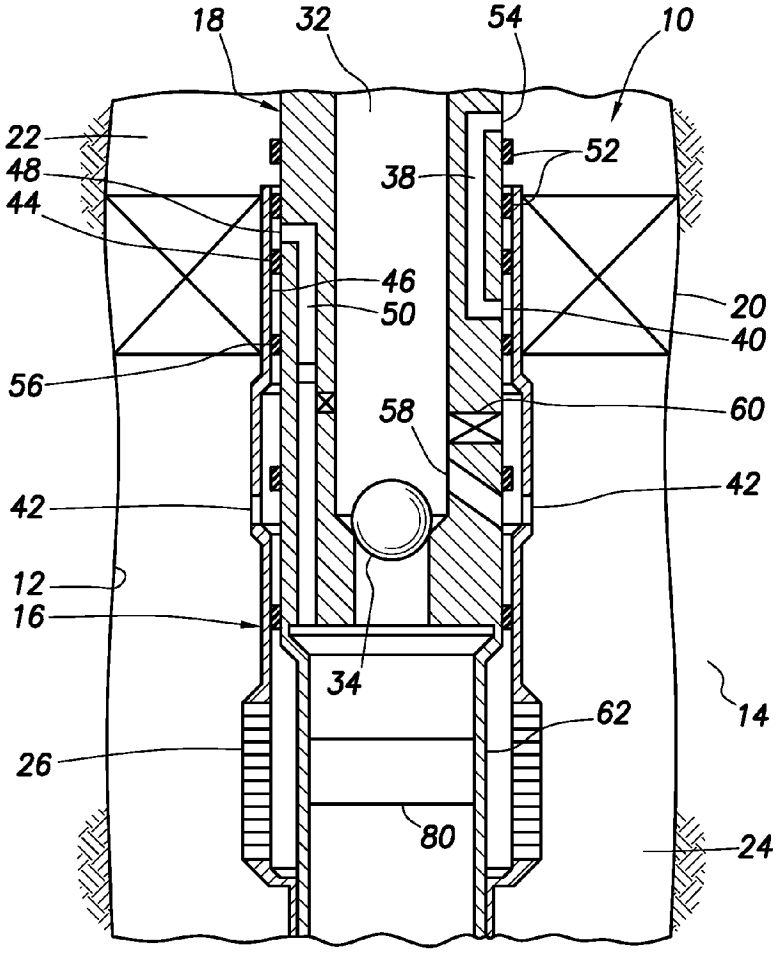

As depicted in FIG. 4, the service string 18 has been raised relative to the completion string 16, which is now secured to the wellbore 12 due to previous setting of the packer 20. In this position, another annular seal 56 carried on the service string 18 is now sealingly engaged in the seal bore 46, thereby isolating the flow passage 38 from the lower annulus 24.

However, the flow passage 32 is now in communication with the lower annulus 24 via the openings 42 and one or more ports 58 in the service string 18. Thus, hydrostatic pressure continues to be communicated to the lower annulus 24. The valve assembly 80 remains in its open configuration.

The lower annulus 24 is isolated from the upper annulus 22 by the packer 20. The flow passage 38 is not in communication with the lower annulus 24 due to the annular seal 56 in the seal bore 46. The flow passage 50 may be in communication with the lower annulus 24, but no flow is permitted through the port 48 due to the annular seal 52 in the seal bore 46. Thus, the lower annulus 24 is isolated completely from the upper annulus 22.

In the FIG. 4 position of the service string 18, the packer 20 can be tested by applying increased pressure to the upper annulus 22 (for example, using surface pumps). If there is any leakage from the upper annulus 22 to the lower annulus 24, this leakage will be transmitted via the openings 42 and ports 58 to surface via the flow passage 32, so it will be apparent to operators at surface and remedial actions can be taken.

Figure 5:
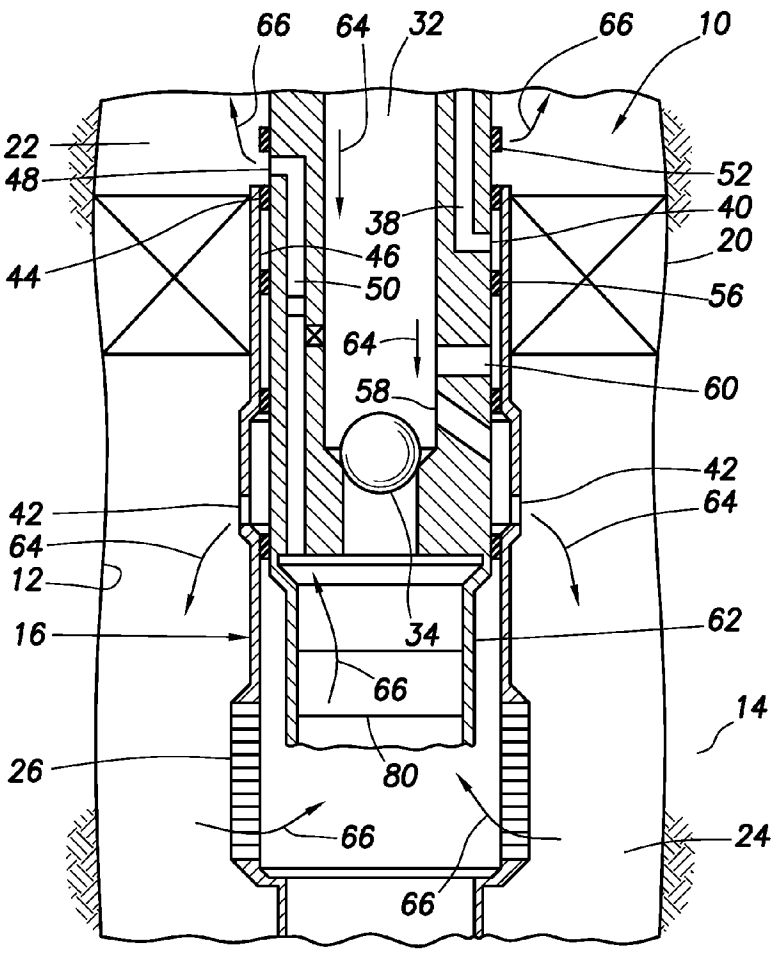

As depicted in FIG. 5, a reversing valve 60 has been opened by raising the service string 18 relative to the completion assembly 16, so that the annular seal 56 is above the seal bore 46, and then applying pressure to the upper annulus 22 to open the reversing valve. The service string 18 is then lowered to its FIG. 5 position (which is raised somewhat relative to its FIG. 4 position).

Thus, in this example, the reversing valve 60 is an annular pressure-operated sliding sleeve valve of the type well known to those skilled in the art, and so operation and construction of the reversing valve is not described or illustrated in more detail by this disclosure. However, it should be clearly understood that the scope of this disclosure is not limited to use of any particular type of reversing valve, or to any particular technique for operating a reversing valve.

The raising of the service string 18 relative to the completion assembly 16 can facilitate operations other than opening of the reversing valve 60. In this example, the raising of the service string 18 can function to prepare a valve assembly 80 connected in or below a washpipe 62 of the service string for closing, as described more fully below. The valve assembly 80 can (when closed) substantially or completely prevent flow from the flow passage 32 into an interior of the well screen 26.

In the FIG. 5 position, the flow passage 32 is in communication with the lower annulus 24 via the openings 42 and ports 58. In addition, the flow passage 50 is in communication with the upper annulus 22 via the port 48. The flow passage 50 is also in communication with an interior of the well screen 26 via the washpipe 62.

A gravel slurry 64 (a mixture of the gravel 28 and one or more fluids 66) can now be flowed from surface through the flow passage 32 of the service string 18, and outward into the lower annulus 24 via the openings 42 and ports 58. The fluids 66 can flow inward through the well screen 26, into the washpipe 62, and to the upper annulus 22 via the flow passage 50 for return to surface. In this manner, the gravel 28 is deposited into the lower annulus 24 (see FIGS. 6 & 7).

Figure 6:
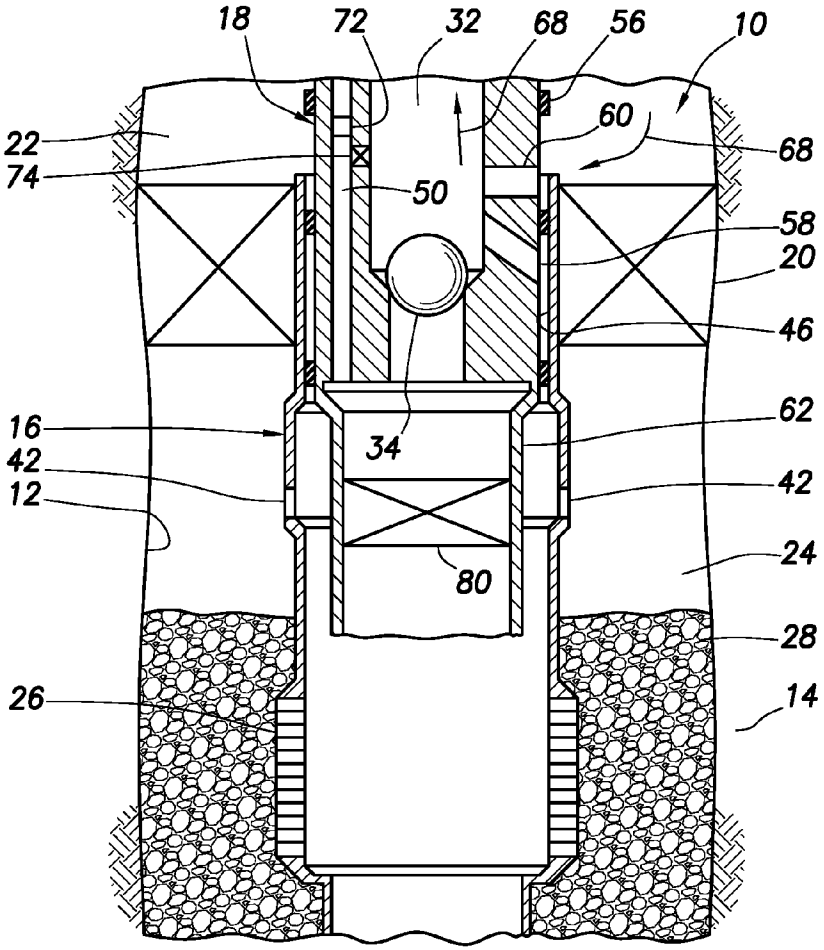

As depicted in FIG. 6, the service string 18 has been raised further relative to the completion assembly 16 after the gravel slurry 64 pumping operation is concluded. The annular seal 56 is now out of the seal bore 46, thereby exposing the reversing valve 60 again to the upper annulus 22. The valve assembly 80 is in its closed configuration.

A clean fluid 68 can now be circulated from surface via the upper annulus 22 and inward through the open reversing valve 60, and then back to surface via the flow passage 32. This reverse circulating flow can be used to remove any gravel 28 remaining in the flow passage 32 after the gravel slurry 64 pumping operation.

After reverse circulating, the service string 18 can be conveniently retrieved to surface and a production tubing string (not shown) can be installed. Flow through the openings 42 is prevented when the service string 18 is withdrawn from the completion assembly 16 (e.g., by shifting a sleeve of the type known to those skilled in the art as a closing sleeve). A lower end of the production tubing string can be equipped with annular seals and stabbed into the seal bore 46, after which fluids can be produced from the formation 14 through the gravel 28, then into the well screen 26 and to surface via the production tubing string.

Figure 7:
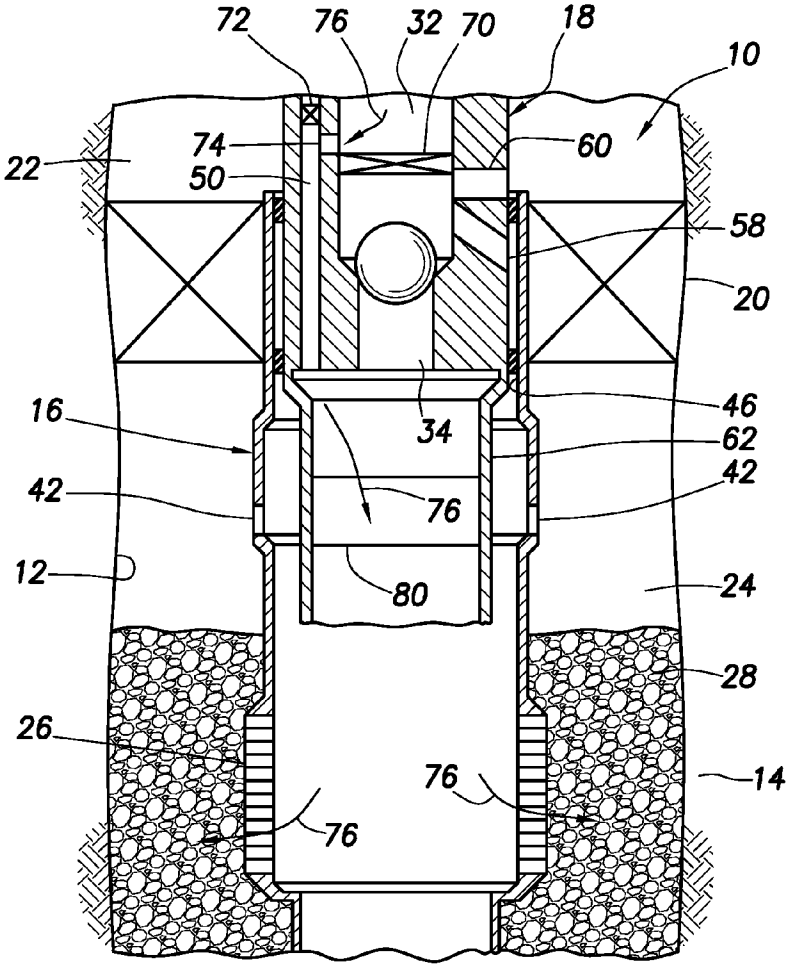

An optional treatment step is depicted in FIG. 7. This treatment step can be performed after the reverse circulating step of FIG. 6, and before retrieval of the service string 18.

As depicted in FIG. 7, another ball, dart or other plug 70 is installed in the flow passage 32, and then increased pressure is applied to the flow passage. This increased pressure causes a lower portion of the flow passage 50 to be isolated from an upper portion of the flow passage (e.g., by closing a valve 72), and also causes the lower portion of the flow passage 50 to be placed in communication with the flow passage 32 above the plug 70 (e.g., by opening a valve 74). Suitable valve arrangements for use as the valves 72, 74 are described in U.S. Pat. Nos. 6,702,020 and 6,725,929, although other valve arrangements may be used in keeping with the principles of this disclosure.

The lower portion of the flow passage 50 is, thus, now isolated from the upper annulus 22. However, the lower portion of the flow passage 50 now provides for communication between the flow passage 32 and the interior of the well screen 26 via the washpipe 62. Note, also, that the lower annulus 24 is isolated from the upper annulus 22.

A treatment fluid 76 can now be flowed from surface via the flow passages 32, 50 and washpipe 62 to the interior of the well screen 26, and thence outward through the well screen into the gravel 28. If desired, the treatment fluid 76 can further be flowed into the formation 14.

The treatment fluid 76 could be any type of fluid suitable for treating the well screen 26, gravel 28, wellbore 12 and/or formation 14. For example, the treatment fluid 76 could comprise an acid for dissolving a mud cake (not shown) on a wall of the wellbore 12, or for dissolving contaminants deposited on the well screen 26 or in the gravel 28. Acid may be flowed into the formation 14 for increasing its permeability. Conformance agents may be flowed into the formation 14 for modifying its wettability or other characteristics. Breakers may be flowed into the formation 14 for breaking down gels used in a previous fracturing operation. Thus, it will be appreciated that the scope of this disclosure is not limited to use of any particular treatment fluid, or to any particular purpose for flowing treatment fluid into the completion assembly 16.

As depicted in FIG. 7, the valve assembly 80 is again in its open configuration. In this open configuration of the valve assembly 80, the service string 18 can be retrieved from the well, without "swabbing" (decreasing pressure in) the well below the packer 20. The valve assembly 80 can be opened for retrieval of the service string 18, whether or not a treatment operation is performed (e.g., the valve assembly can be opened after the reverse circulation step of FIG. 6, whether or not the treatment fluid 76 is flowed into the well as depicted in FIG. 7).

Although only a single packer 20, well screen 26 and gravel packing operation is described above for the FIGS. 1-7 example, in other examples multiple packers and well screens may be provided, and multiple gravel packing operations may be performed, for respective multiple different zones or intervals of the formation 14 or multiple formations. The scope of this disclosure is not limited to any particular number or combination of any components of the system 10, or to any particular number or combination of steps in the method.

Figure 8:
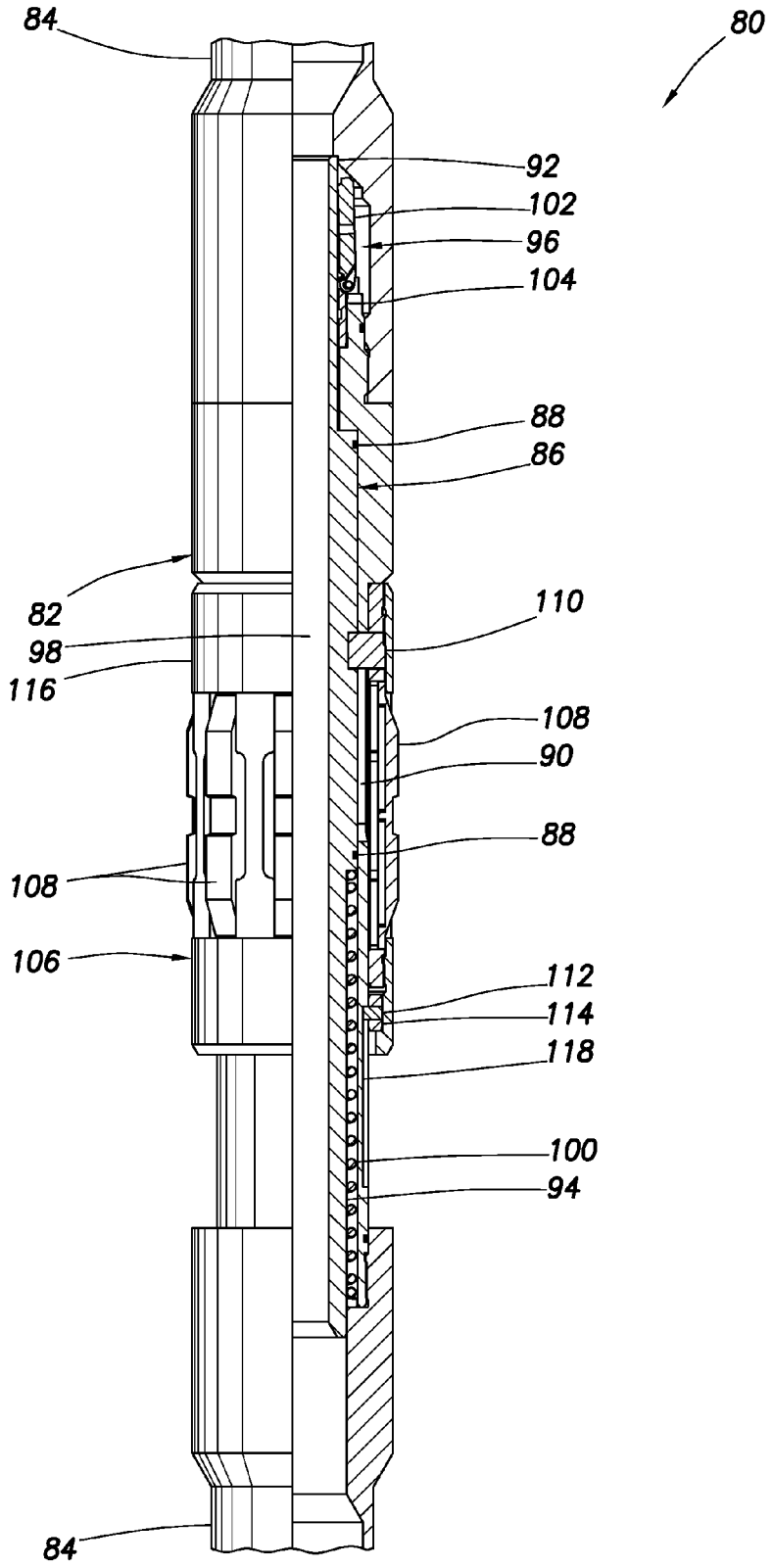
FIG. 8 is a representative enlarged scale partially cross-sectional view of a downhole valve assembly which may be used in the system and method of FIGS. 1-7, the valve assembly being depicted in an open run-in configuration.

Referring additionally now to FIG. 8, the valve assembly 80 is representatively illustrated apart from the remainder of the system 10 and method of FIGS. 1-7. The valve assembly 80 may be used with other systems and methods, and for purposes other than gravel packing, in keeping with the principles of this disclosure.

As depicted in FIG. 8, the valve assembly 80 is in its open configuration. In the FIGS. 1-7 gravel packing example, the valve assembly 80 can be in its open configuration during the FIG. 2 installation step, the FIG. 3 packer setting step, the FIG. 4 packer testing step and the FIG. 7 treatment/retrieval step. Although FIG. 5 depicts the valve assembly 80 in the gravel slurry flowing step as being open as the fluid 66 flows upward through the washpipe 62, it may be the flow that causes the valve assembly to open, in which case the valve assembly could be closed in the absence of the flow.

In the FIG. 8 example, the valve assembly 80 includes a generally tubular housing 82 with end connectors 84 for connecting the valve assembly in a tubular string (such as the washpipe 62). The end connectors 84 may typically be provided with suitable threads, seals, etc., for securing and sealing the valve assembly 80 in the tubular string.

Sealingly and reciprocably received in the housing 82 is a generally tubular mandrel 86. Seals 88 carried on the mandrel 86 prevent fluid communication through a longitudinally extending slot 90 formed through the housing 82.

At an upper end (as viewed in FIG. 8), a generally tubular extension or opening prong 92 is formed on the mandrel 86. In the open configuration of FIG. 8, the opening prong 92 maintains a flapper valve 96 open, thereby permitting relatively unrestricted flow in both directions through a flow passage 98 extending longitudinally through the valve assembly 80. When used with the system 10 of FIGS. 1-7, the flow passage 98 forms a lower section of the flow passage 32.

Another generally tubular extension 94 is formed on the mandrel 86 at a lower end thereof (as viewed in FIG. 8). A biasing device 100 is retained radially between the extension 94 and the housing 82.

The biasing device 100 exerts an upwardly directed (as viewed in FIG. 8) biasing force against the mandrel 86. Thus, the biasing device 100 urges the mandrel 86 toward its FIG. 8 position, in which the opening prong 92 retains the flapper valve 96 open.

The biasing device 100 is depicted in FIG. 8 as a coiled compression spring. However, in other examples, other types of biasing devices may be used (such as, gas chambers, elastomers, compressible liquids, extension springs, etc.). Thus, the scope of this disclosure is not limited to any particular details of the biasing device 100 or other components of the valve assembly 80, as described herein or depicted in the drawings.

The flapper valve 96 includes a closure or flapper 102 pivotably secured relative to a seat 104. The seat 104 is received in an upper end of the housing 82, and is configured for sealing engagement with the flapper 102 when the flapper valve 96 is closed (see FIG. 10). If another type of valve is used (such as, a ball valve, or sliding or rotary sleeve valve), a closure of the valve may not be a flapper.

As depicted in FIG. 8, the opening prong 92 maintains the flapper 102 pivoted upward and out of sealing engagement with the seat 104. A biasing device (such as a torsion spring, not visible in FIG. 8) may be used to bias the flapper 102 toward sealing engagement with the seat 104 when the opening prong 92 is displaced downward, as described more fully below.

Reciprocably disposed on the housing 82 is an engagement device 106 including a circumferentially distributed set of engagement members or keys 108. The keys 108 are configured for releasable engagement with one or more internal profiles in an outer tubular string (such as the completion assembly 16). The keys 108 in this example are biased radially outward (for example, using leaf springs, not visible in FIG. 8).

A pin 110 is secured to the engagement device 106, extends through the slot 90, and is secured to the mandrel 86. In this manner, the mandrel 86 and the engagement device 106 can reciprocably displace together relative to the housing 82. Engagement of the pin 110 in the slot 90 also prevents rotation of the engagement device 106 relative to the housing 82.

A pin-shaped follower 112 protrudes inwardly from an annular rotary bearing 114. The bearing 114 permits the follower 112 to rotate about the housing 82 in a case 116 of the engagement device 106.

The follower 112 is received in a profile 118 formed on the housing 82. The profile 118 is of the type known to those skilled in the art as a "ratchet" or "J-slot" profile. As described more fully below, when the engagement device 106 displaces longitudinally relative to the housing 82, the follower 112 traverses a succession of different sections of the profile 118, thereby controlling an extent of the longitudinal displacement to be changed.

In other examples, the follower 112 could be rigidly secured to the housing 82 and the profile 118 could be carried by the bearing 114. In further examples, the profile 118 could be in the form of a raised track, instead of a recessed slot, and the follower 112 could be a "female" rather than a "male" member. Thus, it will be appreciated that the scope of this disclosure is not limited to any particular details of the engagement device 106 or any of its components.

As depicted in FIG. 8, the engagement device 106 is in a fully upwardly displaced position relative to the housing 82. The follower 112 is engaged in an upwardly extended section of the profile 118. The opening prong 92 maintains the flapper valve 96 open.

In this configuration, the valve assembly 80 can be displaced through a tubular string (such as the completion assembly 16) in a downward direction. If the tubular string includes one or more internal profiles engageable by the keys 108, the keys may momentarily engage the profile(s), but the keys will disengage from the profile(s) as soon as a sufficient downward force is applied to cause the keys to retract (due to mating surfaces on the keys 108 and the internal profiles being angled somewhat). Thus, downward displacement of the valve assembly 80 will not cause actuation of the valve assembly between its open and closed configurations.

Figure 9:
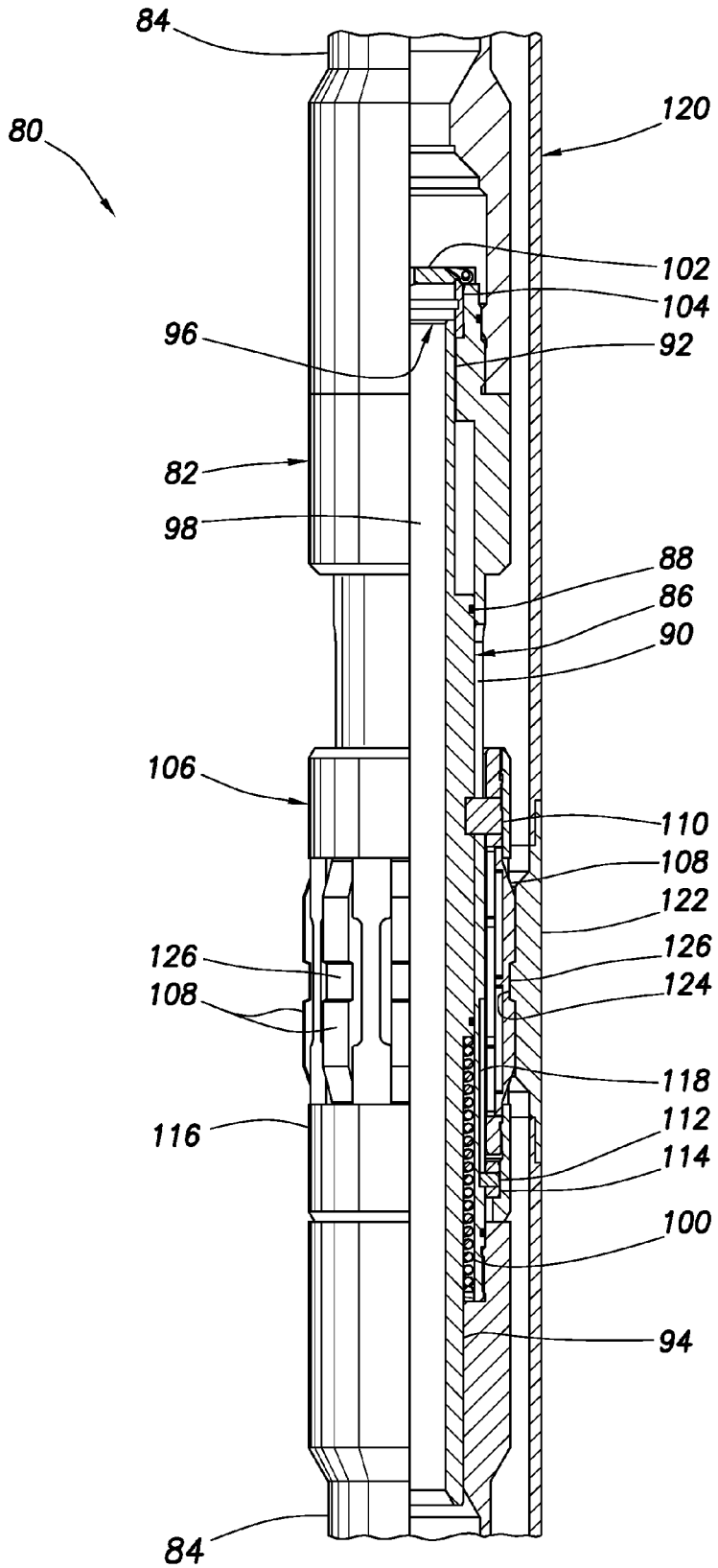
FIG. 9 is a representative partially cross-sectional view of the valve assembly as it is displaced through an internal profile.

Referring additionally now to FIG. 9, the valve assembly 80 is representatively illustrated as being reciprocably disposed within a tubular string 120. The tubular string 120 could comprise a section of the completion assembly 16 of the FIGS. 1-7 example, or it may be another type of tubular string in other examples.

The tubular string 120 includes a coupling 122 having an internal radially inwardly extending shoulder or profile 124 formed therein. The profile 124 is complementarily shaped relative to a recessed profile 126 on each of the keys 108.

As depicted in FIG. 9, the valve assembly 80 has been displaced upwardly relative to the tubular string 120, thereby causing the keys 108 to releasably engage the profile 124 in the coupling 122. After the keys 108 have engaged the profile 124, further upward displacement of the valve assembly 80 (including the housing 82, connectors 84 and flapper valve 96) will cause the biasing device 100 to be compressed while the engagement device 106 and mandrel 86 remain stationary relative to the tubular string 120.

The keys 108 will remain in engagement with the profile 124 until a sufficient upward or downward force is applied to the valve assembly 80 to cause the keys to retract (due to mating surfaces on the keys 108 and the internal profile 124 being angled somewhat). Preferably, the biasing force exerted by the biasing device 100 is at no point greater than this force needed to retract the keys 108 out of engagement with the profile 124.

Note that, in the FIG. 9 configuration, the follower 112 is received in a section of the profile 118 that permits the engagement device 106 to displace fully downward relative to the housing 82. In this example, the engagement device 106 contacts the lower connector 84 when the engagement device is fully downwardly displaced relative to the housing 82.

As described above, the valve assembly 80 can displace downwardly through the tubular string 120 and traverse one or more profiles 124, without causing actuation of the valve assembly between its open and closed configurations. However, as the valve assembly 80 is displaced upwardly through the tubular string 120, the keys 108 will engage a profile 124, the engagement device 106 and mandrel 86 will cease displacing relative to the tubular string, the biasing device 100 will be compressed, and then the keys will disengage from the profile 124 when a sufficient upward force is applied to the valve assembly (due to mating surfaces on the keys 108 and the internal profile 124 being angled somewhat).

Figure 10:
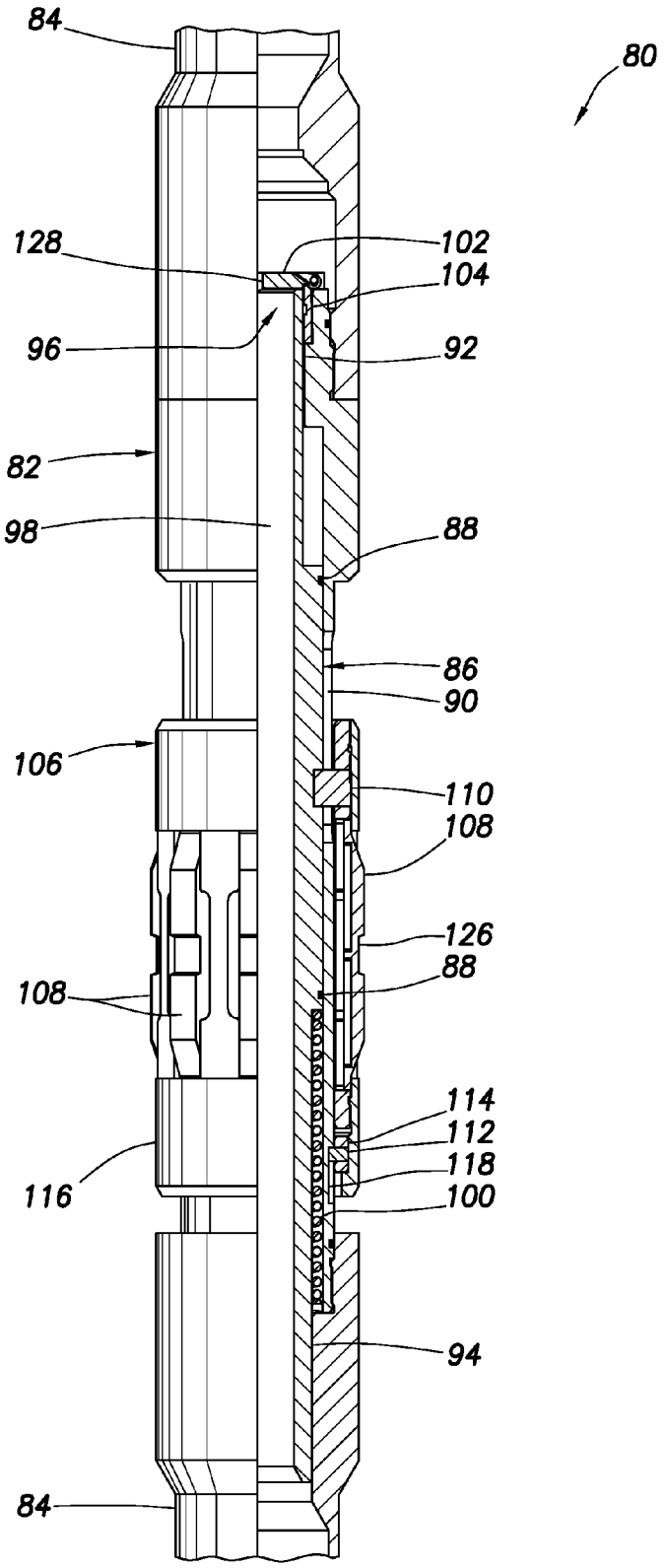
FIG. 10 is a representative partially cross-sectional view of the valve assembly in a closed configuration after displacement through the internal profile.

Referring additionally now to FIG. 10, the valve assembly 80 is representatively illustrated after the keys 108 have disengaged from the profile 124 (the tubular string 120 is not depicted in FIG. 10 for clarity of illustration). The biasing force exerted by the biasing device 100 has displaced the engagement device 106 and the mandrel 86 upward relative to the housing 82 and the flapper valve 96.

However, note that the engagement device 106 and mandrel 86 are not displaced upward to their FIG. 8 positions. Instead, the follower 112 is now received in a section of the profile 118 that prevents further upward displacement of the engagement device 106. As a result, the opening prong 92 remains below the flapper 102.

In the FIG. 10 closed configuration, the flapper 102 can sealingly engage the seat 104. Such sealing engagement can prevent (or at least substantially restrict) flow downwardly through the passage 98. Flow upward through the passage 98 can cause the flapper 102 to pivot upward out of sealing engagement with the seat 104.

Thus, in the closed configuration, the flapper valve 96 functions as a check valve, permitting relatively unrestricted flow in only one direction through the passage 98. In the example of FIGS. 1-7, the valve assembly 80 may be in this configuration during pumping of the gravel slurry 64 (see FIG. 5, the flapper valve 96 being opened by flow of the fluid 66 upwardly through the passage 98), and during the reverse circulating step of FIG. 6.

The valve assembly 80 in the closed configuration of FIG. 10 does not completely prevent flow through the passage 98. Instead, a small hole 128 is formed through the flapper 102 to allow a small amount of fluid seepage through the flapper valve 96. This allows the service string 18 to be retrieved, even if the valve assembly 80 fails to be reopened in the FIGS. 1-7 example. However, in other examples, the hole 128 may not be used, or the flapper valve 96 may otherwise completely prevent downward flow through the passage 98 in the closed configuration.

The valve assembly 80 can be returned to its FIG. 8 open configuration by again displacing it upwardly through a profile 124 in the tubular string 120. This profile 124 used to open the valve assembly 80 may be the same as the one used to close the valve assembly, or it may be a different profile.

As the valve assembly 80 in its closed configuration is displaced upwardly through the tubular string 120, the keys 108 engage will the profile 124, the engagement device 106 and mandrel 86 will cease displacing relative to the tubular string, the biasing device 100 will be compressed, and then the keys will disengage from the profile 124 when a sufficient upward force is applied to the valve assembly. The biasing force exerted by the biasing device 100 will then displace the engagement device 106 and the mandrel 86 upward relative to the housing 82 and the flapper valve 96, thereby returning the valve assembly 80 to its FIG. 8 open configuration.

Figure 11:
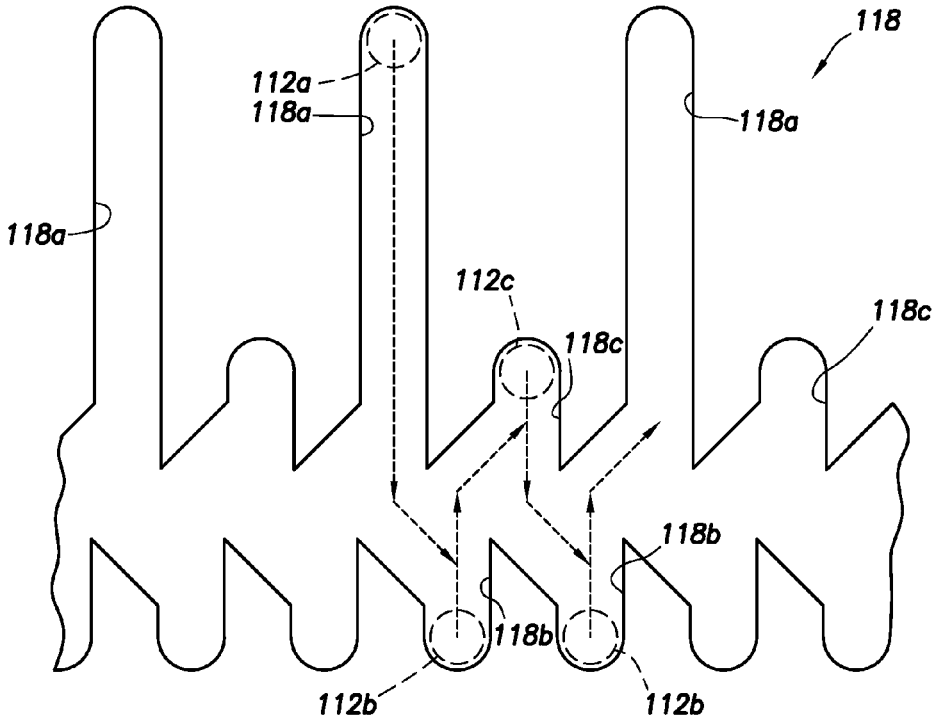
FIG. 11 is a representative side view of an external J-slot profile.

Referring additionally now to FIG. 11, an example of the profile 118 is representatively illustrated in a planar "rolled out" view, it being understood that the profile in the FIGS. 8-10 example actually extends circumferentially about the housing 82. In this view, various positions of the follower 112 relative to the profile 118 are indicated as positions 112*a-c*.

The position 112*a* corresponds to the open configuration of FIG. 8. The follower 112 is received in a relatively long upwardly extending section 118*a* of the profile 118.

The position 112*b* corresponds to the partially actuated configuration of FIG. 9 (in which the engagement device 106 is engaged with the profile 124 and the housing 82 is displaced upward relative to the engagement device). The follower 112 is received in a downwardly extending section 118*b* of the profile 118.

The position 112*c* corresponds to the closed configuration of FIG. 10. The follower 112 is received in a relatively short upwardly extending section 118*c* of the profile 118 (thereby preventing the opening prong 92 from pivoting the flapper 102 out of engagement with the seat 104).

With the profile 118 of FIG. 11, upward displacement of the valve assembly 80 through one or more profiles 124 will cause the valve assembly to be alternately actuated to its closed and open positions. However, in other examples, it may be desirable to use other shapes for the profile 124 to produce different actuation sequences.

Figure 12:
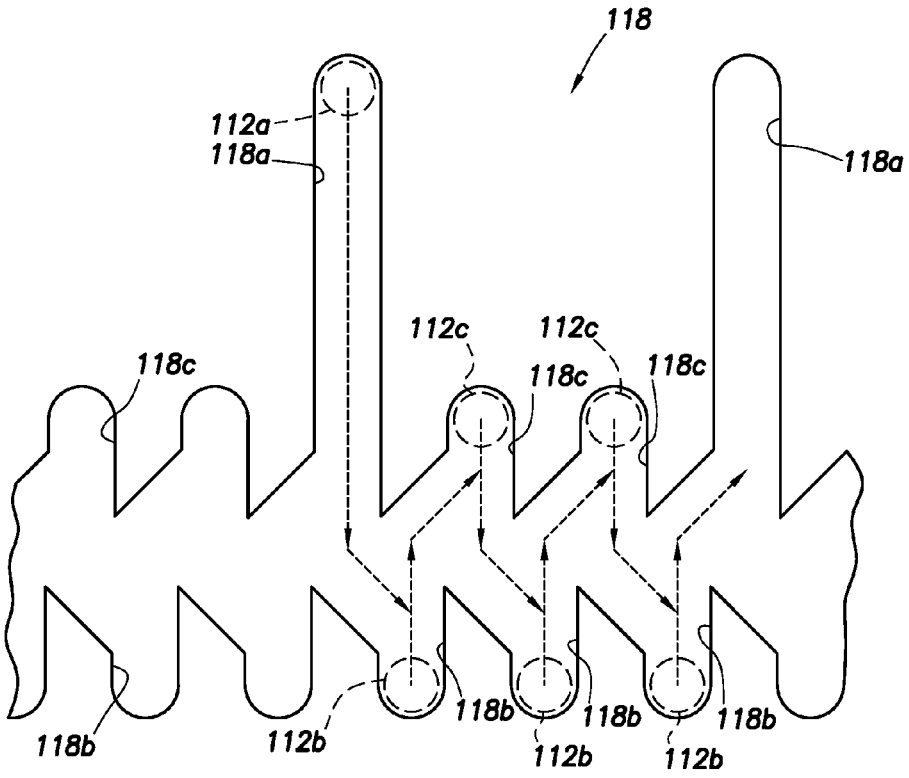
FIG. 12 is a representative side view of another example of the J-slot profile.

In FIG. 12, another example of the profile 118 is representatively illustrated. In this example, a series of upward displacements of the valve assembly 80 through one or more profiles 124 will cause the valve assembly to close, to remain closed, to open, and then to repeat this series of closed-closed-open configurations. This is due to the profile 118 of FIG. 12 having two relatively short upwardly extending sections 118*c* between each pair of relatively long upwardly extending sections 118*a*. It will be appreciated that a variety of different shapes of the profile 124 can be provided to produce any desired sequence of opening and closing the valve assembly 80.

In the FIGS. 8-12 examples, downward displacement of the valve assembly 80 through a profile 124 will not cause actuation of the valve assembly between its open and closed positions. However, in other examples, such downward displacement could be used for actuating the valve assembly 80.

The engagement device 106, biasing device 100 and profile 118 of the valve assembly 80 could be inverted from their FIGS. 8-12 orientations. In that case, the valve assembly 80 would be actuated between its open and closed positions in response to downward displacement through a profile 124, and upward displacement would not cause actuation of the valve assembly.

In another example, the entire valve assembly 80 could be inverted from its FIGS. 8-12 orientation, in which case the flapper valve 96 when closed could prevent (or at least substantially restrict) upward flow through the passage 98, but permit relatively unrestricted downward flow through the passage. Thus, the scope of this disclosure is not limited to any particular orientation or manner of actuating the valve assembly 80.

Figure 13:
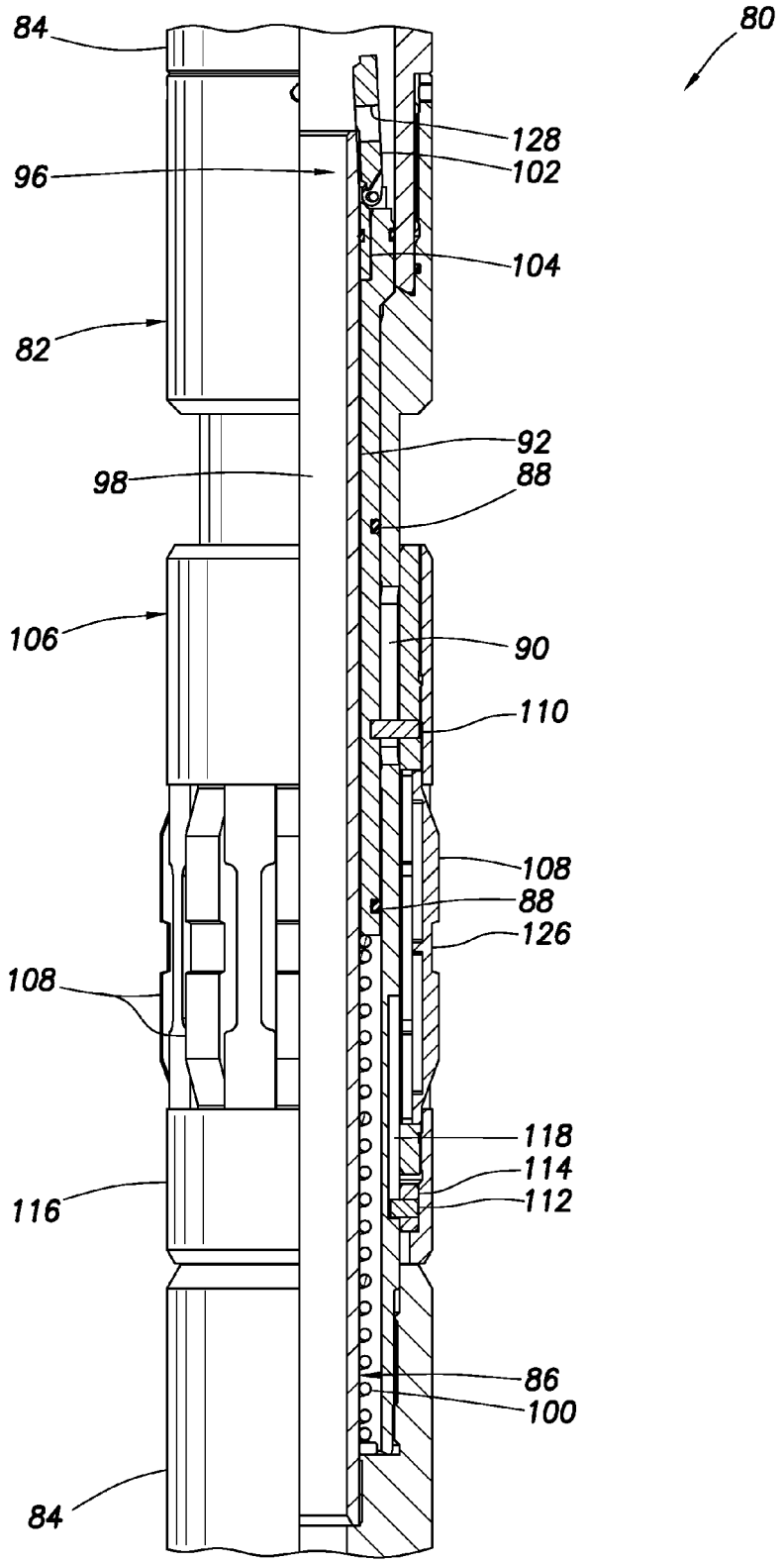
FIGS. 13 & 14 are representative cross-sectional views of another example of the valve assembly in respective open and closed configurations.
Figure 14:
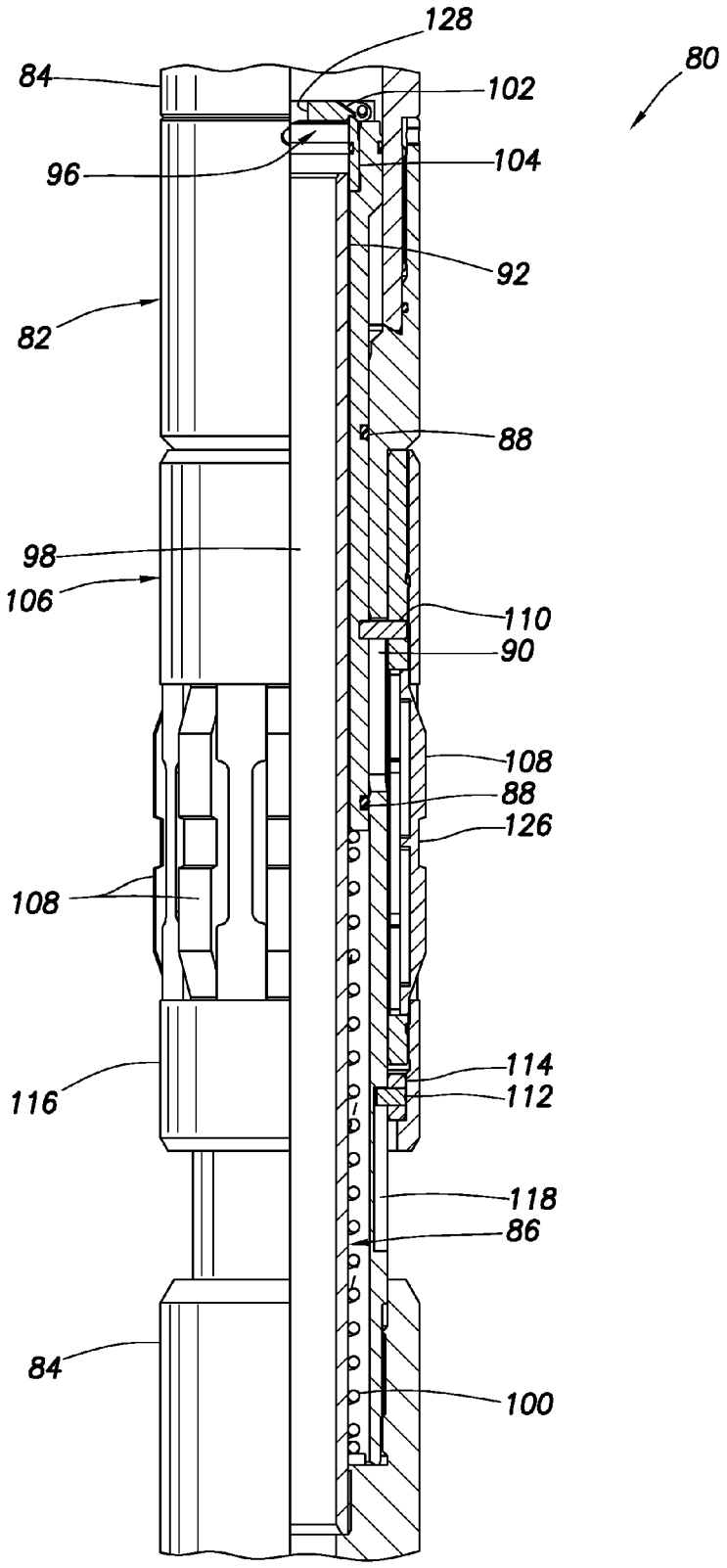

Referring additionally now to FIGS. 13 & 14, another example of the valve assembly 80 is representatively illustrated in respective open and closed configurations. In this example, the mandrel 86 is not displaced relative to the housing 82 to operate the flapper valve 96. Instead, the engagement device 106 is connected to the flapper valve 96 via the pin 110, and thus the flapper valve displaces with the engagement device relative to the housing 82. Otherwise, operation of the FIGS. 13 & 14 example is substantially the same as that described above for the FIGS. 8-12 example.

As depicted in FIG. 13, the flapper valve 96 and engagement device 106 are in a downwardly displaced position, and the opening prong 92 extends through the seat 104 and pivots the flapper 102 to its open position. As depicted in FIG. 14, the flapper valve 96 and engagement device 106 are in an upwardly displaced position, and the flapper 102 is now positioned above the opening prong 92 and pivoted downward to its closed position.

It may now be fully appreciated that the above disclosure provides significant advancements to the arts of constructing and operating downhole valves. In examples described above, the valve assembly 80 can provide for enhanced convenience and reliable operation in gravel packing and other well operations.

The above disclosure provides to the art a valve assembly 80 for use in a subterranean well. In one example, the valve assembly 80 can include a generally tubular housing 82, a mandrel 86 reciprocably disposed in the housing 82 and operative to displace a valve closure 102 in response to relative displacement between the mandrel 86 and the housing 82, an engagement device 106 reciprocably disposed externally on the housing 82 and secured relative to the mandrel 86, whereby the mandrel displaces with the engagement device, and a biasing device 100 that biases the mandrel 86 and engagement device 106 in a selected longitudinal direction.

A limit of longitudinal displacement of the engagement device 106 relative to the housing 82 in the longitudinal direction may vary in response to a change in position of a follower 112 relative to a profile 118. The follower 112 may rotate about the housing 82. The profile 118 may be formed on the housing 82.

The valve closure 102 can comprise a flapper. The mandrel 86 may contact the flapper and pivot the flapper away from a seat 104 in response to displacement of the mandrel 86 in the longitudinal direction.

The engagement device 106 may include at least one engagement member 108 that engages a profile 124 in a tubular string 120 external to the valve assembly 80. In response, the engagement device 106 ceases to displace relative to the profile 124 and the housing 82 displaces in the longitudinal direction relative to the engagement device 106.

The valve assembly 80 may be actuated to an open configuration in response to displacement of the valve assembly in the longitudinal direction through a tubular string 120 external to the valve assembly. The valve assembly 80 may be actuated to a closed configuration in response to displacement of the valve assembly in the longitudinal direction through the tubular string 120.

A system 10 for use in a subterranean well is also provided to the art by the above disclosure. In one example, the system 10 can include a tubular string 120 and a valve assembly 80 reciprocably disposed in the tubular string. The valve assembly 80 includes a valve 96 that selectively restricts flow through a passage 98 formed longitudinally through the valve assembly. The valve 96 closes in response to displacement of the valve assembly 80 in a selected longitudinal direction relative to the tubular string 120, and the valve 96 opens in response to displacement of the valve assembly 80 in the same longitudinal direction relative to the tubular string 120.

The tubular string 120 may include at least one internal profile 124. The valve 96 closes further in response to displacement of a housing 82 of the valve assembly 80 relative to the internal profile 124, and the valve 96 opens further in response to displacement of the housing 82 relative to the internal profile 124.

The valve assembly 80 may include a mandrel 86 reciprocably disposed in the housing 82, and a biasing device 100 that biases the mandrel in the longitudinal direction relative to the housing.

The valve assembly 80 may include a profile 118 and a follower 112. A position of a mandrel 86 relative to the valve 96 is determined by a position of the follower 112 relative to the profile 118.

The mandrel 86 may contact and displace a closure 102 of the valve 96 to an open position in response to displacement of the follower 112 to one position relative to the profile 118. The mandrel 86 may disengage from the closure 102 and allow the closure 102 to displace to a closed position in response to displacement of the follower 112 to a second position relative to the profile 118.

The valve assembly 80 may include a housing 82 and an engagement device 106 that engages an internal profile 124 in the tubular string 120. The valve 96 closes in response to displacement of the engagement device 106 in the longitudinal direction relative to the housing 82, and the valve 96 opens in response to displacement of the engagement device 106 in the same longitudinal direction relative to the housing 82.

The valve assembly 80 may include a biasing device 100. The biasing device 100 displaces the engagement device 106 in the longitudinal direction relative to the housing 82 in response to disengagement of the engagement device from the internal profile 124.

A method of gravel packing a well is also described above. In one example, the method comprises: displacing a service string 18 in a selected longitudinal direction within a completion assembly 16, the service string 18 including a valve assembly 80 that selectively restricts flow through a longitudinal flow passage 32 of the service string; opening the valve assembly 80 as the valve assembly displaces in the longitudinal direction; and closing the valve assembly 80 as the valve assembly displaces in the same longitudinal direction.

The displacing step may include compressing a biasing device 100 in response to engagement between an engagement device 106 of the valve assembly 80 and an internal profile 124 in the completion assembly 16.

The opening step may include the biasing device 100 elongating in response to disengagement between the engagement device 106 and the internal profile 124. The closing step may also include the biasing device 100 elongating in response to disengagement between the engagement device 106 and the internal profile 124.

The opening step may include the engagement device 106 displacing in the longitudinal direction relative to a housing 82 of the valve assembly 80. The closing step may include the engagement device 106 displacing in the same longitudinal direction relative to the housing 82.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A valve assembly for use in a subterranean well, the valve assembly comprising:

a generally tubular housing;

a mandrel reciprocably disposed in the housing and operative to displace a valve closure in response to relative displacement between the mandrel and the housing;

an engagement device reciprocably disposed externally on the housing and secured relative to the mandrel, whereby the mandrel displaces with the engagement device; and a biasing device that biases the mandrel and engagement device in a selected longitudinal direction, wherein the valve assembly is actuated to an open configuration in response to displacement of the valve assembly in the longitudinal direction through a tubular string external to the valve assembly, and wherein the valve assembly is actuated to a closed configuration in response to displacement of the valve assembly in the longitudinal direction through the tubular string.

2. The valve assembly of claim 1, wherein a limit of longitudinal displacement of the engagement device relative to the housing in the longitudinal direction varies in response to a change in position of a follower relative to a profile.

3. The valve assembly of claim 2, wherein the follower rotates about the housing.

4. The valve assembly of claim 2, wherein the profile is formed on the housing.

5. The valve assembly of claim 1, wherein the valve closure comprises a flapper, and wherein the mandrel contacts the flapper and pivots the flapper away from a seat in response to displacement of the mandrel in the longitudinal direction.

6. The valve assembly of claim 1, wherein the engagement device includes at least one engagement member that engages a profile in the tubular string external to the valve assembly, and in response the engagement device ceases to displace relative to the profile and the housing displaces in the longitudinal direction relative to the engagement device.

7. A system for use in a subterranean well, the system comprising:

a tubular string;

a valve assembly reciprocably disposed in the tubular string, the valve assembly including a housing, an engagement device that engages an internal profile in the tubular string, and a valve that selectively restricts flow through a passage formed longitudinally through the valve assembly, wherein the valve closes in response to displacement of the valve assembly in a selected longitudinal direction relative to the tubular string and in response to displacement of the engagement device in the longitudinal direction relative to the housing, and wherein the valve opens in response to displacement of the valve assembly in the longitudinal direction relative to the tubular string and in response to displacement of the engagement device in the longitudinal direction relative to the housing.

8. The system of claim 7, wherein the valve closes further in response to displacement of the housing relative to the internal profile, and wherein the valve opens further in response to displacement of the housing relative to the internal profile.

9. The system of claim 8, wherein the valve assembly further includes a mandrel reciprocably disposed in the housing, and a biasing device that biases the mandrel in the longitudinal direction relative to the housing.

10. The system of claim 7, wherein the valve assembly further includes a profile and a follower, and wherein a position of a mandrel relative to the valve is determined by a position of the follower relative to the valve assembly profile.

11. The system of claim 10, wherein the mandrel contacts and displaces a closure of the valve to an open position in response to displacement of the follower to a first position relative to the valve assembly profile, and wherein the mandrel disengages from the closure and allows the closure to displace to a closed position in response to displacement of the follower to a second position relative to the valve assembly profile.

12. The system of claim 7, wherein the valve assembly further includes a biasing device, and wherein the biasing device displaces the engagement device in the longitudinal direction relative to the housing in response to disengagement of the engagement device from the tubular string internal profile.

13. A method of gravel packing a well, the method comprising:

displacing a service string in a selected longitudinal direction within a completion assembly, the service string including a valve assembly that selectively restricts flow through a longitudinal flow passage of the service string, and the valve assembly including a housing and an engagement device;

engaging the engagement device with an internal profile in the completion assembly;

opening the valve assembly as the valve assembly displaces in the longitudinal direction, the valve assembly opening in response to displacement of the engagement device in the longitudinal direction relative to the housing; and closing the valve assembly as the valve assembly displaces in the longitudinal direction, the valve assembly closing in response to displacement of the engagement device in the longitudinal direction relative to the housing.

14. The method of claim 13, wherein the displacing comprises compressing a biasing device in response to engagement between the engagement device of the valve assembly and the internal profile in the completion assembly.

15. The method of claim 14, wherein the opening comprises the biasing device elongating in response to disengagement between the engagement device and the internal profile.

16. The method of claim 15, wherein the closing comprises the biasing device elongating in response to disengagement between the engagement device and the internal profile.

* * * * *